US006575434B2

(12) United States Patent
Bligh et al.

(10) Patent No.: US 6,575,434 B2
(45) **Date of Patent: *Jun. 10, 2003**

(54) APPARATUS AND METHODS FOR STRENGTHENING GUARDRAIL INSTALLATIONS

(75) Inventors: Roger P. Bligh, Bryan, TX (US); King K. Mak, San Antonio, TX (US); Hayes E. Ross, Jr., College Station, TX (US)

(73) Assignee: The Texas A&M University System, College Station, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/465,635

(22) Filed: Dec. 17, 1999

(65) Prior Publication Data

US 2001/0048101 A1 Dec. 6, 2001

(51) Int. Cl.[7] ..... E01F 15/00
(52) U.S. Cl. ..... 256/13.1; 256/1
(58) Field of Search ..... 256/1, 13.1

(56) References Cited

U.S. PATENT DOCUMENTS

| | | | | | |
|---|---|---|---|---|---|
| 1,625,716 | A | * | 4/1927 | Edwards | 256/13.1 |
| 1,793,675 | A | * | 2/1931 | Camp | 256/13.1 |
| 1,977,286 | A | * | 10/1934 | Miller | 256/13.1 |
| 2,043,525 | A | * | 6/1936 | Benedict | 256/13.1 |
| 2,160,519 | A | * | 5/1939 | Robertson | 256/13.1 |
| 4,161,090 | A | * | 7/1979 | Watts, Jr. | 52/301 |
| 4,324,388 | A | * | 4/1982 | Klaser | 256/13.1 X |
| 4,678,166 | A | * | 7/1987 | Bronstad et al. | 256/13.1 |
| 4,739,971 | A | * | 4/1988 | Ruane | 256/13.1 |
| 4,928,928 | A | | 5/1990 | Buth et al. | |
| 5,152,507 | A | * | 10/1992 | Lee | 256/13.1 |
| 5,402,987 | A | * | 4/1995 | Duyck et al. | 256/13.1 |
| 5,407,298 | A | | 4/1995 | Sicking et al. | |
| 5,421,556 | A | * | 6/1995 | Dodge et al. | 256/1 |
| 5,487,618 | A | * | 1/1996 | Cox | 256/13.1 X |
| 5,765,811 | A | * | 6/1998 | Alberson et al. | 256/13.1 |
| 5,791,812 | A | * | 8/1998 | Ivey | 256/13.1 X |
| 6,022,003 | A | * | 2/2000 | Sicking et al. | 256/13.1 |
| 6,036,399 | A | * | 3/2000 | Schalk | 256/13.1 |
| 6,173,943 | B1 | * | 1/2001 | Welch et al. | 256/13.1 |
| 6,220,575 | B1 | * | 4/2001 | Lindsay et al. | 256/13.1 |

FOREIGN PATENT DOCUMENTS

| | | | | |
|---|---|---|---|---|
| DE | 1256000 | A | * 12/1967 | 256/13.1 |

* cited by examiner

*Primary Examiner*—Lynne H. Browne
*Assistant Examiner*—Ryan Flandro
(74) *Attorney, Agent, or Firm*—Madan, Mossman & Sriram, P.C.; Shawn Hunter

(57) ABSTRACT

Devices and methods for strengthening the upper portions of the support posts for guardrails and guardrail end treatments against the forces that are imparted to the post during an impact. The upper portions of support posts, particularly the areas proximate the bolt connection, are reinforced. Preferably, a compressive force is applied to those areas as well by the reinforcements. In one embodiment, reinforcement for the upper portion of the post is provided by metal banding that is disposed around the periphery of the post. Alternative exemplary embodiments are also described in which reinforcement to the upper portion of the post is provided by plates that are secured into place on a location proximate the connection bolt and by a metal cap that sits atop the post. In another embodiment, the drilled hole and connection bolt are eliminated.

15 Claims, 4 Drawing Sheets

APPARATUS AND METHODS FOR STRENGTHENING GUARDRAIL INSTALLATIONS

BACKGROUND

1. Field of the Invention

The present invention is directed to devices and methods for improving the integrity and performance capabilities of guardrail installations. In particular, the invention is directed to devices and methods for strengthening the support posts and entire installation to accommodate redirection impacts along the length of a guardrail.

2. Description of the Related Art

Guardrail installations are longitudinal safety devices that extend along the sides of highways and roadways. In their usual construction, a corrugated rail member is supported above the ground by a number of support posts that are often fashioned of wood. The rail member is interconnected to each post by a connection bolt that passes through a drilled hole in the post.

Guardrail installations usually experience two types of vehicle impacts, and should be designed to function well in response to each. The first type of impact is an end-on impact in which one end of the guardrail installation is impacted by a vehicle that approaches the guardrail from a substantially end-on direction. In this type of impact, the guardrail installation should perform in a controlled manner in order to absorb the energy of the colliding vehicle. To accommodate this performance, frangible (or break-away) posts, which are structurally weakened at or near the ground level to assist in breaking the post away, are sometimes used at the upstream end of a guardrail installation. A number of guardrail end treatments have been devised to assist the controlled performance of the rail member during an end-on impact. These include the guardrail extruder terminal, which is known commercially as the ET-2000, and the slotted rail terminal.

The second type of impact that a guardrail should be designed for is a redirection impact wherein a colliding vehicle approaches and engages the guardrail substantially from the lateral side. In this type of impact, the role of the guardrail installation is to redirect the vehicle back into its lane of traffic and provide a resilient, but non-yielding barrier that will prevent the colliding vehicle from penetrating the rail member and passing through to the opposite side of the guardrail installation. This aspect of guardrail design is important because a colliding vehicle that passes through a guardrail might travel into an area of extreme danger, such as a lane of traffic moving in the opposite direction or toward a precipice. This barrier role is the principal function of a guardrail installation.

The inventors have determined that the point at which the connection bolt passes through the guardrail post is a location of true vulnerability for the support posts during a redirection impact. The presence of the drilled hole for the guardrail attachment bolt has weakened the post to a degree. In addition, forces applied to the bolt from the rail member, as might occur in a redirection impact collision, impart strong forces to the drilled hole which can easily split the post in half. When this occurs, the posts may split and, thus, the rail member may be released from the posts, and the ability of the guardrail to prevent a colliding vehicle from passing through it is compromised or destroyed. The inventors have learned through crash testing that such failures often cause the guardrail to lose integrity and allow vehicles to penetrate the guardrail.

In the past, attempts to strengthen guardrail installations against penetration from redirection impacts have focused on increasing the number of support posts that anchor the rail member to the ground or by using larger, thicker support posts, or both. Unfortunately, these options significantly increase the expense of the guardrail installation. More importantly, however, they inhibit the ability of the guardrail to perform its other intended purpose providing a controlled activation or collapse during end-on impacts. Larger and stronger posts, or an increased number of posts, stiffen the guardrail system and degrade its ability to perform in an acceptable manner during an end-on impact. In addition, an impact by a vehicle with a thicker, stronger post may stop the vehicle abruptly and severely damage it, resulting in greater injuries to the occupants.

It would be an improvement to have a device and method that addresses the problems of the prior art.

SUMMARY OF THE INVENTION

The present invention provides devices and methods for strengthening the upper portions of the support post assemblies of guardrails and guardrail end treatments against the forces that are imparted to the post during an impact. The upper portions of support posts, particularly the areas proximate the bolt connection, are reinforced. Preferably, a compressive force is applied to those areas as well by the reinforcements.

In one preferred embodiment, reinforcement for the upper portion of the post is provided by metal banding that is disposed around the periphery of the post. Alternative exemplary embodiments are also described in which reinforcement to the upper portion of the post is provided by plates that are secured into place at a location proximate the connection bolt or by a metal cap that sits atop the post. In a further alternative embodiment, a strengthened support post assembly is provided by eliminating from the post the drilled hole and connection bolt disposed therewithin. The rail member is instead affixed to a collar that surrounds the post.

The methods and devices of the present invention optimize the strength of the support post assemblies for guardrail installations. They also allow guardrail installations to be inexpensively strengthened to provide increased redirection capability in response to redirection impacts. At the same time, the guardrail installation's ability to collapse in a controlled manner in response to end-on impacts is not reduced.

DETAILED DESCRIPTION OF THE PREFERRED EMBODIMENTS

Figure 1:
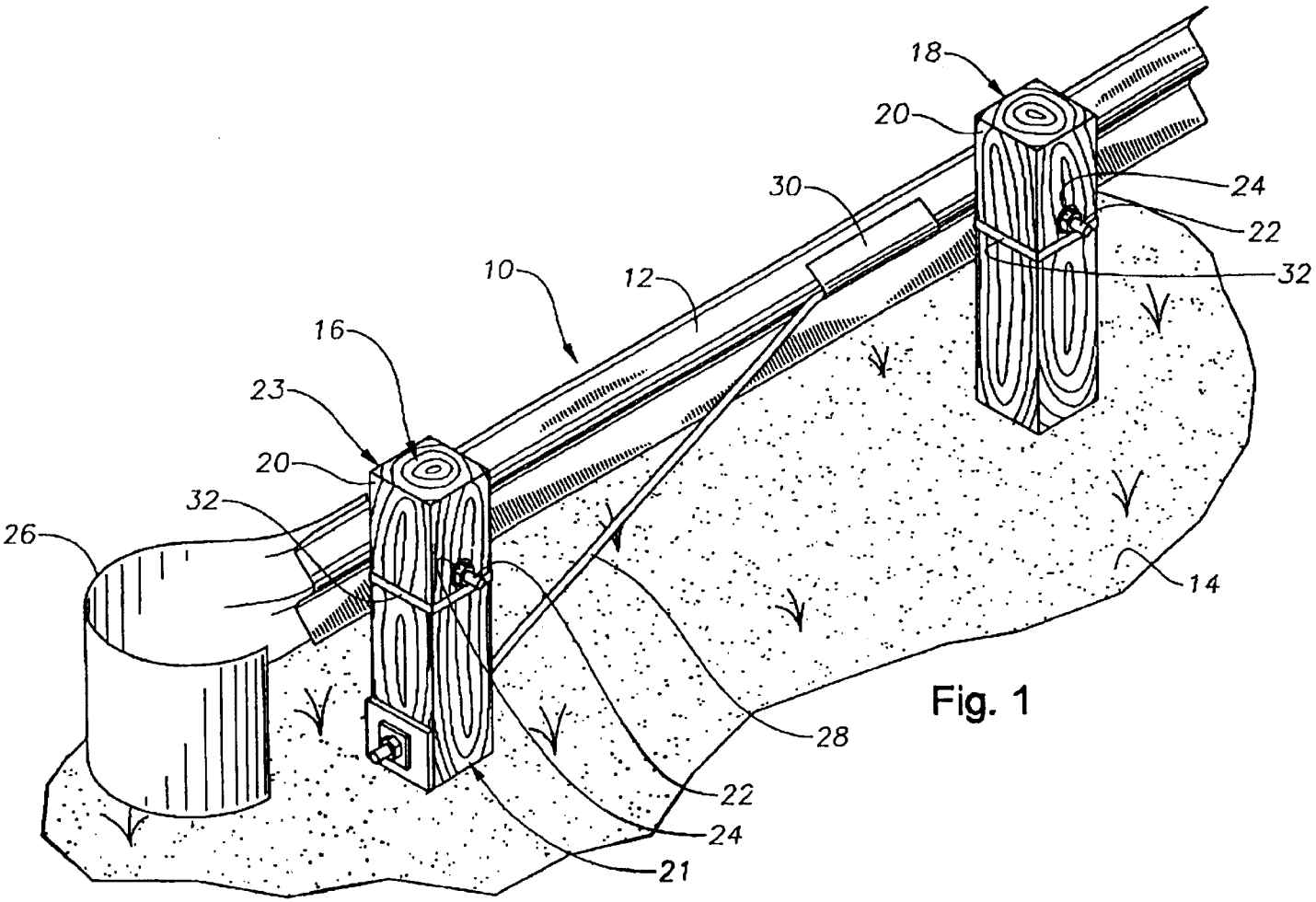
FIG. 1 illustrates an exemplary guardrail installation having several support posts that have been reinforced against splitting or other upper portion failures.

FIG. 1 depicts an exemplary guardrail installation 10 having a longitudinal, corrugated rail member 12 that is supported above the ground 14 by a plurality of support post assemblies 16, 18. Although only the upstream end of the guardrail installation 10 is depicted, it should be understood that portions of the guardrail assembly 10 may extend for a desired distance in a downstream direction and may be of any length. These portions will be, likewise supported by additional support post assemblies that are not shown. The term upstream is intended herein to mean that end or portion of the guardrail installation which faces the direction from which traffic is expected to approach. It is noted that the invention also has application to the opposite, downstream, end and other portions of a guardrail installation as well.

Each of the post assemblies 16, 18 includes a wooden post 20. The posts 20 have a lower portion, shown generally at 21, that is disposed within the ground 14 and an upper portion, shown generally at 23, that is affixed to the rail member 12. The lower portion 21 is typically disposed within the ground 14 by burying, but may also be disposed within the ground 14 by inserting the lower portion 21 into a foundation tube (not shown) of a type known in the art.

The upper portion 23 of the post 20 is considered herein to be that portion of the post that lies proximate the bolt 22 and the top of the post 20. The upper portion 23 encompasses approximately the upper ⅓ to ½ of the portion of the post 20 that is exposed above ground. The support posts 20 may be round or rectangular in cross-sectional shape. The posts 20 are typically formed of wood.

A bolt hole (not visible in FIG. 1) has been drilled through each of the posts 20 and a bolt 22 is disposed through each hole as well as the rail member 12. The bolt 22 has a flattened head (also not visible in FIG. 1) on one end and is threaded at the other end to receive a nut and washer 24.

The upstream portion of a guardrail installation typically has an end treatment that helps prevent spearing or vaulting of vehicles that impact the guardrail from substantially end-on. There are a number of such end treatments known and in use. In FIG. 1, a curved rail end treatment 26 is depicted wherein the corrugations of the rail member 12 are flattened out and the end then curved around to help distribute the crash forces over a larger area on the impacting vehicle. Other end treatments include, for example, the guardrail extruder terminal which is described in U.S. Pat. No. 4,928,928 and the slotted rail terminal which is described in U.S. Pat. No. 5,407,298. Each of these patents is incorporated herein by reference.

It is pointed out that the two guardrail post assemblies 16, 18, being located the furthest upstream in the installation 10, may be break-away guardrail post assemblies. As a result, they will, or are intended to, fracture near the level of the ground 14. Post cable 28, of a type known in the art, is anchored at one end to the lower portion 21 of the first post assembly 16 and extends upward to a cable anchor 30 that secures the cable 28 to the rail member 12. The post cable 28 helps anchor and provide tensile strength to the rail member 12 to enable the installation 10 to redirect vehicles impacting along the length of the rail member 12.

Figure 8:
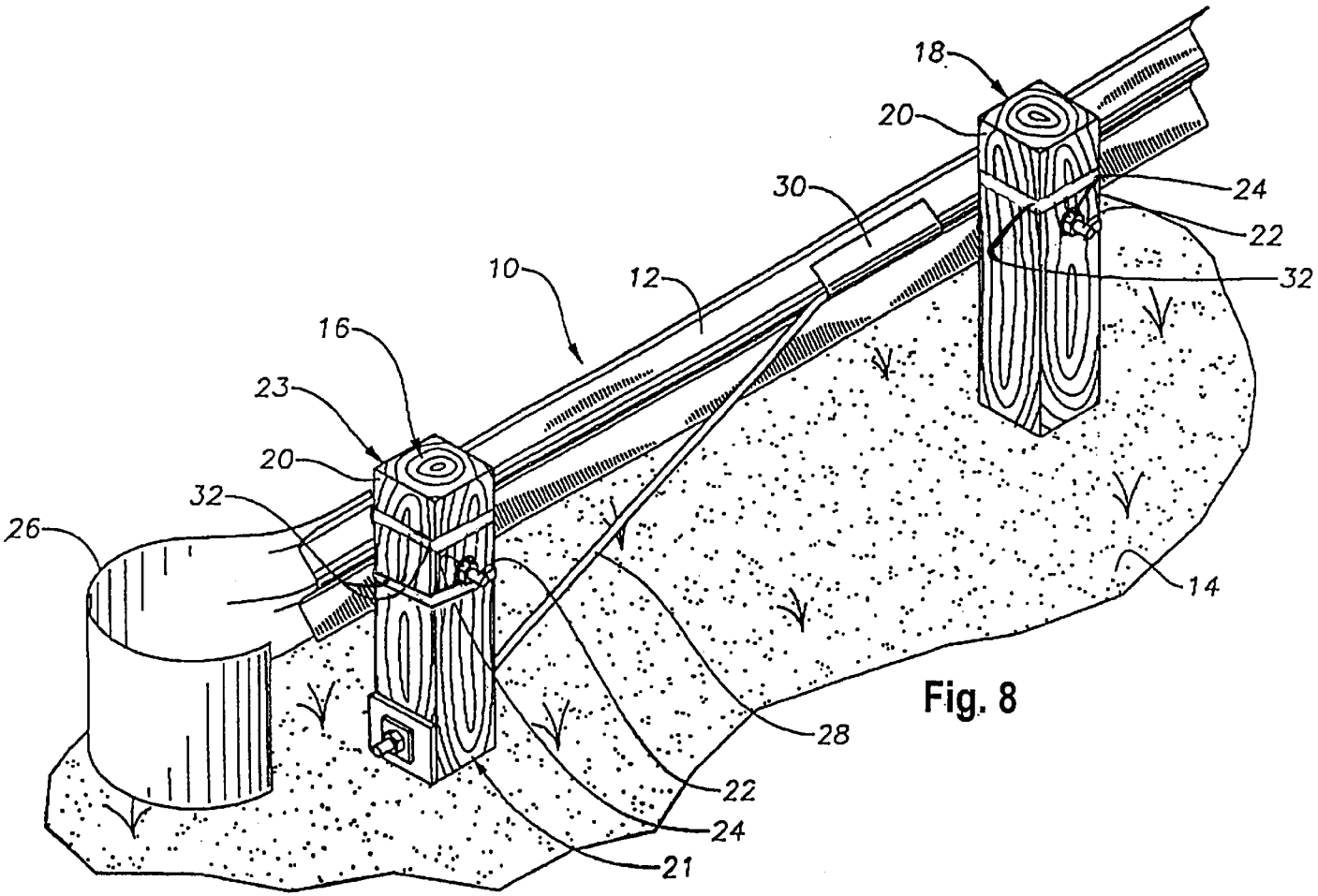

In order to strengthen the upper portion 23 of the posts 20, a reinforcement is operably associated with the posts 20. In the installation shown in FIG. 1, a strip 32 of metal banding surrounds an area of the upper portion 23 of each post 20 proximate the bolt 22. The strip 32 is shown located slightly below the bolt 22 arising from tensile forces transmitted through rail member 12. However, it may also be located above the bolt 22, as shown in FIG. 8. If desired, one or more such strips may be placed on either side of the bolt 22. The strip 32 is preferably applied to the posts 20 by use of a banding machine of a type known in the art. In addition, the banding is preferably tightened so as to apply a compression load to the posts 20 by tightening the strip 32 so that inwardly-directed forces are applied to the portions of the post 20 that are proximate the bolt 22. These compression forces act as countervailing forces to those post-splitting forces that would act upon the post 20 due to lateral movement of the bolt 22 within its bolt hole. Tightening of the strip 32 also ensures that the strip 32 does not move upwardly or downwardly upon the post 20. A currently preferred size for the banding making up the strip 32 is 19 mm (approximately ¾") in width and 0.38 mm in thickness. Although only the two leading support post assemblies 16, 18 are shown in FIG. 1 to be reinforced in the manner, it should be understood that any or all of the support posts for the guardrail installation 10 may be reinforced as well.

Reinforcement of the support posts 20 in this manner has been shown to be effective during testing in preventing failures of the guardrail during redirection impacts. During a side impact to the rail member 12, the rail member 12 is deformed and lateral forces are applied to the connection bolt 22 as a result, thereby moving the bolt 22 angularly with respect to its drilled hole. The presence of the reinforcement provided by the banding strip 32 helps prevent the movement of the bolt 22 from splitting the post in two. Further, the compressive load applied to the upper portion 23 by the strip 32 acts as a countervailing force to those applied to the post 20 by the bolt 22.

Referring now to FIGS. 2–6, a number of exemplary alternative embodiments are depicted for reinforcing the upper portion 23 of a support post assembly 16. For clarity, like components among the various embodiments are numbered alike. In each of these drawings, the rail member 12 is not shown, although it should be understood that the connection bolt 22 will affix the rail member 12 to the post 20 in the same manner as depicted in FIG. 1.

Figure 2:
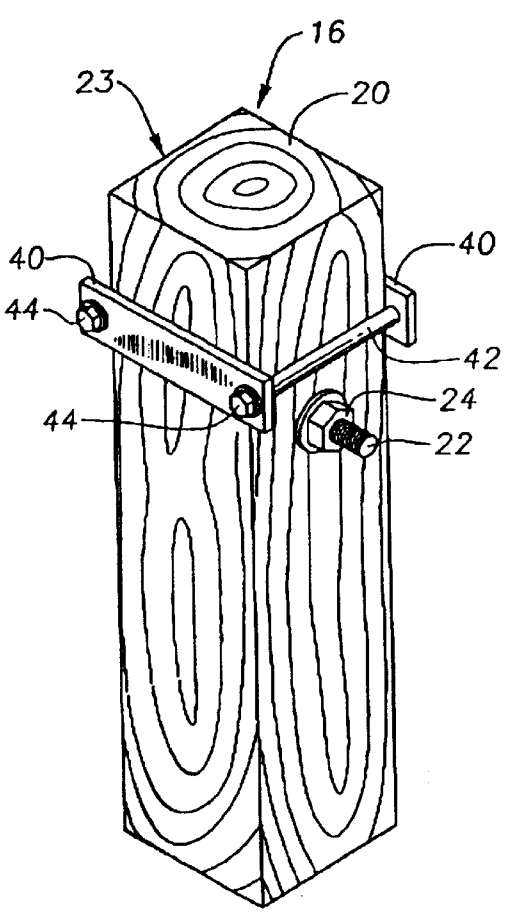

In FIG. 2, a pair of compression plates 40 are affixed to each other by rigid tie rods 42. Threaded nuts 44 hold the plates 40 onto the tie rods 42 and can be tightened to apply the compression load to the post 20.

Figure 3:
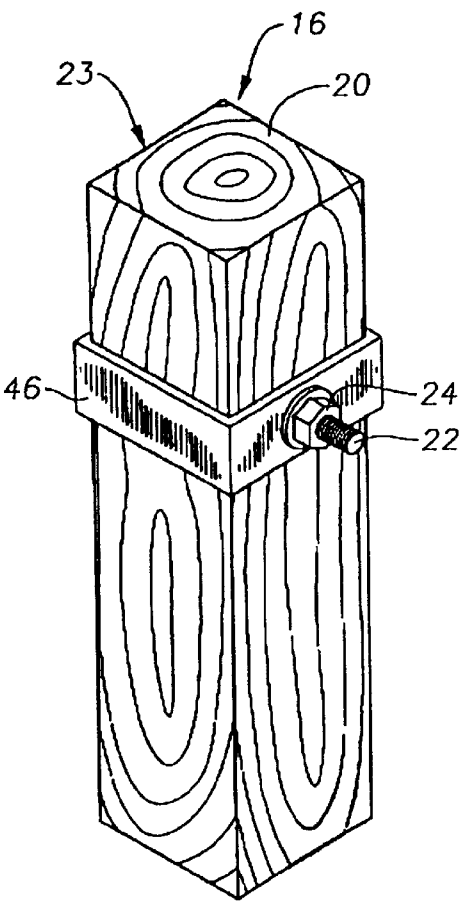

In FIG. 3, a rigid, rectangular collar 46 is disposed around the upper portion 23 of the post 20. The connection bolt 22 passes through holes (not shown) in the collar 46 thereby securing the collar to the post 20. This type of arrangement, while strengthening the upper portion 23 and helping to resist post-splitting forces, does not apply a significant compressive force to the post 20.

Figure 4:
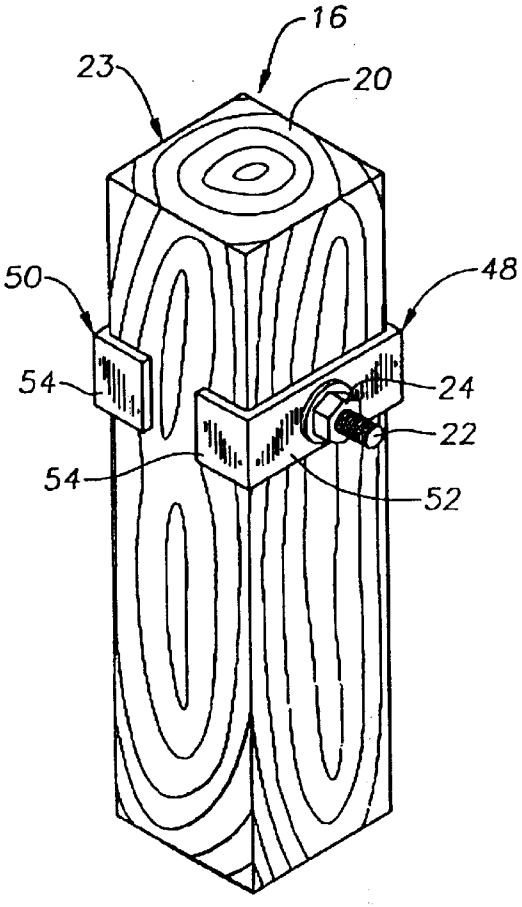
FIGS. 2–8 depict alternative means for reinforcing the upper portion of an exemplary guardrail post.

FIG. 4 illustrates an alternative construction wherein a pair of generally U-shaped brackets 48, 50 are disposed on the upper portion 23 of the post 20. The brackets 48, 50 are held in place on the post 20 by the bolt 22. The brackets 48, 50 each have a central plate 52 and two side pieces 54 (only one visible on each). The nut/washer 24 may be tightened to apply compression loading to the upper portion 23 of the post 20.

Figure 5:
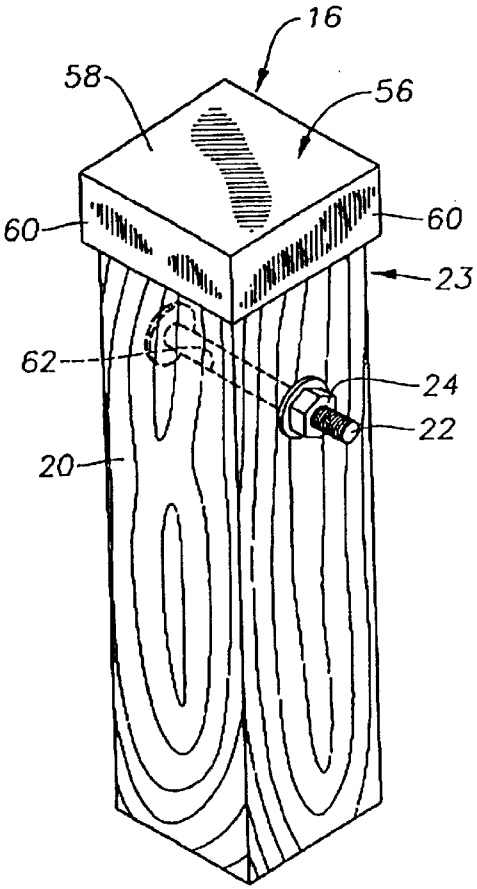

FIG. 5 depicts an embodiment wherein reinforcement is provided to the upper portion 23 by a rigid cap 56 that has a top plate 58 and four side plates 60 (two shown). The cap 56 fits over the top of the post 20, and the sides 60 of the cap 56 help resist post splitting forces. FIG. 5 also illustrates, in phantom, the drilled hole 62 through which the connection bolt 22 is disposed. The cap 56 may be secured to the post 20 using an adhesive or connectors (not shown). Alternatively, the cap 56 may be secured using an interference fit.

Figure 6:
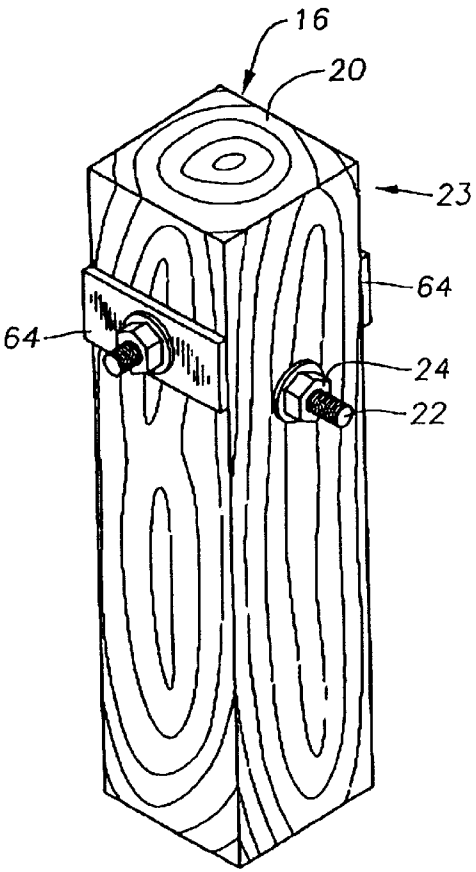

FIG. 6 shows an alternative embodiment of the invention wherein a pair of flat plates 64 are retained against opposite sides of the upper portion 23 of the post 20 by the connection bolt 22 and nut/washer 24.

Figure 7:
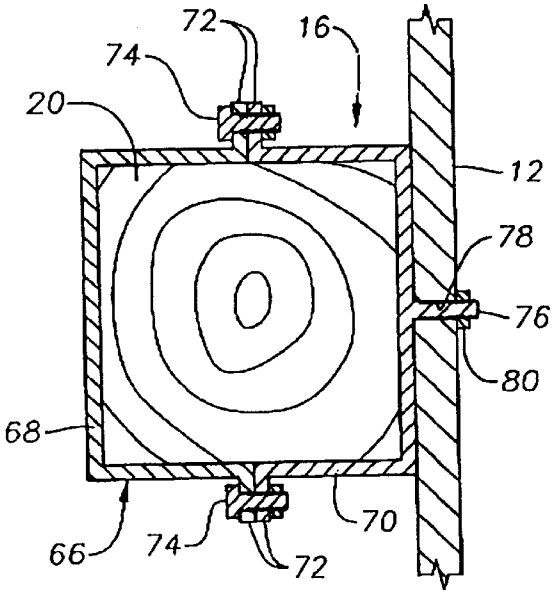

FIG. 7 illustrates a further alternative embodiment for strengthening a guardrail post and guardrail installation. The post assembly 16 is shown in plan cross-section for clarity.

The post 20 is provided with an external rigid collar 66 that is formed of two half sections 68, 70. Each of the half sections 68, 70 has a pair of flanges 72 with apertures disposed therethrough. Nut-and-bolt type connectors 74 are disposed through the apertures of the flanges 72 to secure the half sections together. The connectors 74 are tightened to ensure that the collar 66 is tightly secured against the post 20. A threaded shaft 76 protrudes from the collar 66. The rail member 12 is affixed to the post assembly 16 by disposing the threaded shaft 76 through a complimentary sized aperture 78 in the rail member 12. A nut 80 is then secured upon the shaft 76.

It is noted that the post 20 lacks a drilled hole, such as the drilled hole 62 shown earlier, and no connection bolt is disposed through the post 20. As a result, there is no point of weakness in the post 20 created by these structures. It is pointed out that the rail member 12 could be affixed to the collar 66 in a number of other ways as well, such as by disposing a flathead bolt outwardly through an aperture in the collar 66 and then through the rail member 12. It should be understood that the collar 66 is a connection member that is affixed to the upper portion 23 of the post 20. Forces imparted by the rail member 12 to the shaft 76 during a collision will be transmitted to the collar 66 and act upon the outer portions of the post 20 rather than tending to split it apart.

Reinforcement of guardrail installations using the methods and devices described above is relatively inexpensive as compared with the alternatives of installing additional posts or using larger, stronger posts and avoids any degradation in performance in substantially end-on collisions with the guardrail installation that may arise from implementing of those other methods. In addition, retrofitting of existing guardrail installations can be accomplished relatively easily.

While the invention has been shown or described in only some of its forms, it should be apparent to those skilled in the art that it is not so limited, but is susceptible to various changes within departing from the scope of the invention.

What is claimed is:

1. A guardrail installation comprising:

a longitudinally corrugated rail member;

a plurality of support posts that are affixed to the rail member to support the rail member;

the support posts each having a lower portion that is buried and an upper portion that is affixed to the rail member;

a hole drilled through the upper portion of at least one of said support posts;

a connection bolt disposed through the hole and through the rail member;

a reinforcing member having a laterally-located compression load applying portion for applying inwardly-directed forces to provide reinforcement to the upper portion of that support post from countervailing post-splitting forces resulting from lateral movement of the connection bolt, the reinforcing member comprising a strip of metal banding completely surrounding said at least one of the support posts; and the rail member being affixed by the connection bolt to result in contact between the rail member and said at least one of said support posts.

2. The guardrail assembly of claim 1 wherein the reinforcing member is located above the connection bolt.

3. The guardrail assembly of claim 1 wherein the reinforcing member is located below the connection bolt.

4. The guardrail assembly of claim 1 wherein there are a plurality of reinforcing members surrounding a single support post.

5. A guardrail installation comprising:

a longitudinally corrugated rail member;

a plurality of support posts that are affixed to the rail member to support the rail member;

a hole drilled through an upper portion of each of said support posts;

a connection bolt disposed through the hole of each of said support posts and through the rail member;

a strip of metal banding completely surrounding each of said support posts to provide reinforcement to the upper portion of each support post from countervailing post-splitting forces resulting from lateral movement of the connection bolt; and the connection bolt affixing the rail member to each of said support posts to cause contact between the rail member and each of said support posts.

6. The guardrail installation of claim 5 wherein the strip of metal banding is located proximate the connection bolt.

7. The guardrail installation of claim 6 wherein the strip of metal is located below the connection bolt.

8. The guardrail installation of claim 6 wherein the strip of metal is located above the connection bolt.

9. The guardrail installation of claim 5 wherein a post cable is anchored by being disposed through at least one of said support posts.

10. The guardrail installation of claim 5 wherein the longitudinally corrugated rail member presents a W-shaped cross-section.

11. The guardrail installation of claim 5 wherein the support posts are comprised of wood.

12. A guardrail installation comprising:

a longitudinally corrugated rail member having a W-shaped cross-section;

a plurality of support posts that are affixed to the rail member to support the rail member;

a hole drilled through an upper portion of each of said support posts;

a connection bolt disposed through the hole of each of said support posts and through the rail member;

a strip of metal banding completely surrounding each of said support posts to provide reinforcement to the upper portion of each support post from countervailing post-splitting forces resulting from lateral movement of the connection bolt;

the connection bolt affixing the rail member to each of said support posts to cause contact between the rail member and each of said support posts; and a post cable disposed through the rail member and at least one of said support posts.

13. The guardrail installation of claim 12 wherein the support posts are comprised of wood.

14. A guardrail installation comprising:

a longitudinally corrugated rail member;

a plurality of support posts that are affixed to the rail member to support the rail member;

a hole drilled through an upper portion of each of said support posts;

a connection bolt disposed through each of said support posts and through the rail member;

a strip of metal banding completely surrounding each of said support posts to provide reinforcement to the upper portion of each support post from countervailing post-splitting forces resulting from lateral movement of the connection bolt, the strip of metal banding being of a type that is applied using a banding machine; and the connection bolt affixing the rail member to each of said support posts to cause contact between the rail member and each of said support posts.

15. A guardrail installation comprising:

a longitudinally corrugated rail member having a W-shaped cross-section;

a plurality of support posts that are affixed to the rail member to support the rail member;

a hole drilled through an upper portion of each of said support posts;

a connection bolt disposed through the hole of each of said support posts and through the rail member;

a strip of metal banding completely surrounding each of said support posts to provide reinforcement to the upper portion of each support post from countervailing post-splitting forces resulting from lateral movement of the connection bolt, the strip of metal banding being of a type that is applied using a banding machine and having a width of approximately 19 mm and a thickness of approximately 0.38 mm;

the connection bolt affixing the rail member to each of said support posts to cause contact between the rail member and each of said support posts; and a post cable disposed through the rail member and at least one of said support posts.

* * * * *